US006216393B1

(12) United States Patent
Apprich

(10) Patent No.: US 6,216,393 B1
(45) Date of Patent: Apr. 17, 2001

(54) DEVICE FOR OPENING AND CLOSING A SLIDING DOOR, IN PARTICULAR FOR VEHICLES

(75) Inventor: Harry Apprich, Ludswigsfelde (DE)

(73) Assignee: Apprich Secur 2000 GmbH (DE)

( * ) Notice: Subject to any disclaimer, the term of this patent is extended or adjusted under 35 U.S.C. 154(b) by 0 days.

(21) Appl. No.: 09/194,138

(22) PCT Filed: May 16, 1997

(86) PCT No.: PCT/DE97/01039

§ 371 Date: Jun. 17, 1999

§ 102(e) Date: Jun. 17, 1999

(87) PCT Pub. No.: WO97/44559

PCT Pub. Date: Nov. 27, 1997

(30) Foreign Application Priority Data

| | | |
|---|---|---|
| May 23, 1996 | (DE) | 196 22 290 |
| Sep. 11, 1996 | (DE) | 196 38 741 |
| Mar. 20, 1997 | (DE) | 297 05 763 U |

(51) Int. Cl.[7] ..... E05D 15/10

(52) U.S. Cl. ..... 49/212; 49/216; 49/223; 49/280

(58) Field of Search ..... 49/209, 210, 211, 49/212, 216, 221, 223, 225, 360, 279, 280, 281

(56) References Cited

U.S. PATENT DOCUMENTS

| | | | | |
|---|---|---|---|---|
| 1,997,175 | * | 4/1935 | Gussack | 49/280 X |
| 3,708,914 | * | 1/1973 | Awsund | 49/209 |
| 4,268,996 | * | 5/1981 | Allen | 49/212 |
| 4,377,731 | | 3/1983 | Georgelin . | |
| 4,702,514 | * | 10/1987 | Perry | 49/212 X |

FOREIGN PATENT DOCUMENTS

| | | |
|---|---|---|
| 38 31 698 | 3/1990 | (DE) . |
| 0 718 458 A1 | 2/1996 | (EP) . |
| 2 328 093 | 5/1977 | (FR) . |
| WO 81 03715 | 3/1983 | (WO) . |

* cited by examiner

*Primary Examiner*—Jerry Redman
(74) *Attorney, Agent, or Firm*—Marshall & Melhorn, LLC

(57) ABSTRACT

The invention relates to a device provided with a driving unit (1) which performs the shift and has a linear drive (8,12) provided with an electric motor (5), and a guide device (9,11). The driven member, formed to be linear, of the linear drive (12) and a member of the guide device (9) are fastened on one hand to the door (3), and the driving member of the linear drive (5,7,8) and the other member of the guide device (11) are fastened on the other hand to a mounting (6) which is supported by way of a support arrangement (22, 23, 24, 25, 26) connected to the wall(4). Said support arrangement converts a movement of the mounting substantially perpendicular to the wall into a swinging movement. A locking unit driven by an electric motor is also provided which locks and unlocks the sliding door by performing a movement perpendicular to the wall when it is positioned to close the opening. Control means which has position switches controls the driving and locking unit.

17 Claims, 8 Drawing Sheets

DEVICE FOR OPENING AND CLOSING A SLIDING DOOR, IN PARTICULAR FOR VEHICLES

BACKGROUND OF THE INVENTION

1. Field of the Invention

The invention relates to a device for opening and closing a sliding door, in particular for vehicles.

Sliding doors are provided in particular in vehicles in which access to the interior of the vehicle is provided from the side, for example in minibuses or transport vehicles. Such a sliding door is generally constructed in such a way that in the closed or locked position it terminates flush with the surrounding vehicle body and in the opened state, being offset parallel to the side, is movable along the body in at least one guide rail.

In recent times there has been a growing need to be able to move and close such a sliding door automatically, in particular for certain end uses, for example for taxis, freight vehicles, ambulances or the like.

2. Description of the Prior Art

DE-A-38 31 698 discloses a device for opening and closing a sliding door, in particular for vehicles, which closes an aperture in a side. The device possesses a linear drive constructed as a taut chain with a pinion engaging therein provided with an electric motor for displacing the sliding door parallel to the side of the vehicle as well as for swinging out a mounting supporting the sliding door. In addition a guide device consisting of a guide rail fastened to the sliding door as well as guide rollers fastened to the mounting for guiding the sliding door substantially parallel to the side are provided. The linearly constructed driven member of the linear drive, that is the taut chain, is installed in fixed manner on the sliding door. The mounting is supported via a support arrangement which is connected to the side wall and constructed as a guide parallelogram. The pivot levers of the guide parallelogram are mounted in articulated manner on the one hand on the side wall and on the other hand on the mounting with vertical axes of rotation in each case so that they can exercise a support function for the sliding door. At the same time the drive motor is rigidly attached to one of the pivot levers belonging to the guide parallelogram which convert a movement of the mounting of the sliding door substantially perpendicular to the wall into a pivot movement.

This device according to the state of the art has the disadvantage that extensive measures are necessary on the vehicle chassis in order to attach a guide parallelogram which can swing out and support the sliding door. This is greatly disadvantageous in particular when retrofitting the device for opening and closing the sliding door. It is, furthermore, disadvantageous that despite the automatic closing process the actual locking does not ensue automatically. This can represent a safety risk.

WO 93/17211 discloses a device for opening and closing a horizontally displaceable vehicle door having an endless screw connected to the body. The endless screw is accommodated in a rail. Arranged on the screw is a carriage which is movable in translational manner in the rail, the endless screw being driven by a motor. The carriage is connected to the door via a damped connecting rod which preferably assumes an angle of less than 25° to the endless screw. Furthermore, in the door a locking or unlocking device is provided, the locking or unlocking being carried out via an electromagnet.

SUMMARY OF THE INVENTION

The aim underlying the invention is to provide a device for opening and closing a sliding door which reliably opens and closes or locks the door and has a simple structure as well as a low requirement for space and is thus also highly suitable for retrofitting.

Advantageous refinements and improvements are possible by means of the measures specified in the subsidiary claims.

According to the present invention the device for opening and closing a sliding door which is arranged displaceably in at least one longitudinal guide provided on a side of the vehicle is provided with a running unit which performs the displacement movement and which has a linear drive provided with an electric motor and a guide device. In this case the linearly constructed driven member of the linear drive and a member of the guide device are fastened on the one hand to the door and the driving member of the linear drive and the other member of the guide device working together with the guide member on the door side are fastened on the other hand to a mounting which is supported via a support arrangement connected to the wall. The support arrangement is provided with at least one pivot lever, each mounted in articulated manner, connected on the one hand to the mounting and on the other hand to a bearing connected to the wall, which lever converts a movement of the mounting substantially perpendicular to the wall into a pivot movement. Furthermore, a locking unit driven by the aforesaid electric motor or a further electric motor is provided which locks and unlocks the sliding door in its position closing the aperture by executing a movement perpendicular to the wall. A control device which has positional switches controls the running and locking unit.

Due to this construction, the device for opening and closing a sliding door can be built in such a way that it possesses a relatively simple structure and due to the conversion of the movement of the mounting of the running unit substantially perpendicular to the wall into a pivot movement a space-saving design is possible. In particular, in the retrofitting of the device for opening and closing a sliding door in existing vehicles, in order for instance to equip them in a manner suitable for the handicapped or to convert a conventional minibus into a safety transporter, the retention of the longitudinal guide provided on the vehicle, for retaining the support function of the sliding door for instance, is a decisive advantage since the costs of the modification can therefore be kept low.

The locking unit advantageously possesses a linearly displaceable locking member and a catch member engaging with the locking member, the locking member and/or the catch member being constructed in such a way that the process of coming into engagement is executed simultaneously with the movement perpendicular to the wall. This is preferably achieved in that the outer surface of the locking member and/or of the catch member is constructed in sloping manner.

It is particularly advantageous that the linear drive with electric motor and the guide device as well as the mounting of the running unit are arranged on a preferably trough-shaped support part to form a unit capable of preassembly. Due to this design the assembly of the device for opening and closing can be greatly simplified since the individual parts of the running unit can be preassembled on the support part so that for the assembly of the running unit the support part only has to be connected to the door, for example by gluing or screwing.

A particularly simple construction of the linear drive is to implement it as a toothed rack with a pinion driven by the electric motor and correspondingly an advantageous design of the guide device is to implement it as a linear guide rail having a running carriage enclosing the latter at least in part, the running carriage being advantageously fastened at that point on the mounting at which the greatest force acts.

It is further advantageous that the pivot lever of the support device is constructed as a slide bar arranged displaceably in a guide sleeve, the guide sleeve being mounted in rotatable and pivotable manner. In this case the movement perpendicular to the door or wall is converted into a displacement movement of the pivot lever or of the slide bar in the guide sleeve and a pivot movement of the guide sleeve. In doing so the pivot movement of the guide sleeve takes place about an axis lying parallel to the wall.

In certain cases it can be advantageous that the slide bar member simultaneously forms the locking unit as a catch member, the locking member having a cone or a sloping surface which slides along the circumference of the slide bar.

The locking member can be constructed in part as a toothed rack which can be driven by a pinion connected to the electric motor.

In a further advantageous exemplified embodiment the pivot lever is constructed as a rod which is fastened at one end preferably via a ball-and-socket joint to the bearing and at the other end preferably via a ball-and-socket joint to a further lever connected to the mounting. Of course other joints, e.g. universal joints, can also be provided. In this arrangement the pivot movement of the pivot lever or of the further lever is executed in a horizontal plane, the levers in the fully opened state and in the fully closed state advantageously assuming such a position located outside of the dead center, the dead center being defined as a position in which the pivot lever is located parallel to the wall and forms an angle of 90° with the further lever.

It is particularly advantageous that the toothed rack of the locking unit is arranged adjacent to the toothed rack of the running unit on the door in such a way that only one electric motor with a pinion has to be provided for the running unit and for the locking unit and the pinion successively comes into engagement first with one toothed rack and then with the other rack. Due to this arrangement the device according to the invention can be further simplified and constructed at lower cost.

Due to the provision of a crushing safeguard device which is connected to the control device and which on application of a predetermined force on the door opposite to the displacement movement switches off the electric motor of the running unit or changes its direction of rotation over, use of the device for opening and closing is also possible in passenger transport. A simple mechanical crushing safeguard device is formed in that the bearing of the pivot lever is mounted displaceably against a defined, variably adjustable pretensioning force or the lever itself is extended or shortened against a variably adjustable spring force and a switching device connected to the control device is provided which, depending on the displacement path, is a signal for triggering the electric motor. On account of such a construction a force exercised on the latter when sliding the door shut, for example due to an obstacle in the aperture of the door such as an arm or a hand of person, is transferred directly on to the bearing provided with the pretensioning force and when this force is greater than the pretensioning force switches on the switching device assigned to the bearing and issues a signal to the control device which then addresses the electric motor. In doing this the switching device can be of differing construction, all possible types being conceivable, for example an electromechanical switch, an inductive, capacitance-magnetic, piezoelectric switching device or the like.

Preferably sensors are provided which detect the start and the end of the displacement path and deliver a corresponding signal to the control device, which render the crushing safeguard device inoperable since otherwise due to the acceleration force when starting to slide the door from the open position into the closed position which is greater than the force needed for switching the switching device and due to the friction force at the end of the displacement path which is likewise greater than the switching force, this would respond and could result in an oscillating movement.

The locking unit is preferably arranged in such a way that the locking member or the catch member is provided at the position at which the lock of the sliding door is usually provided. By this means no additional official approval must be undertaken on installation of the locking unit.

BRIEF DESCRIPTION OF THE DRAWINGS

Exemplified embodiments of the invention are illustrated in the drawings and are explained in more detail in the following description. The drawings show.

DETAILED DESCRIPTION OF THE PREFERRED EMBODIMENT

Figure 1:
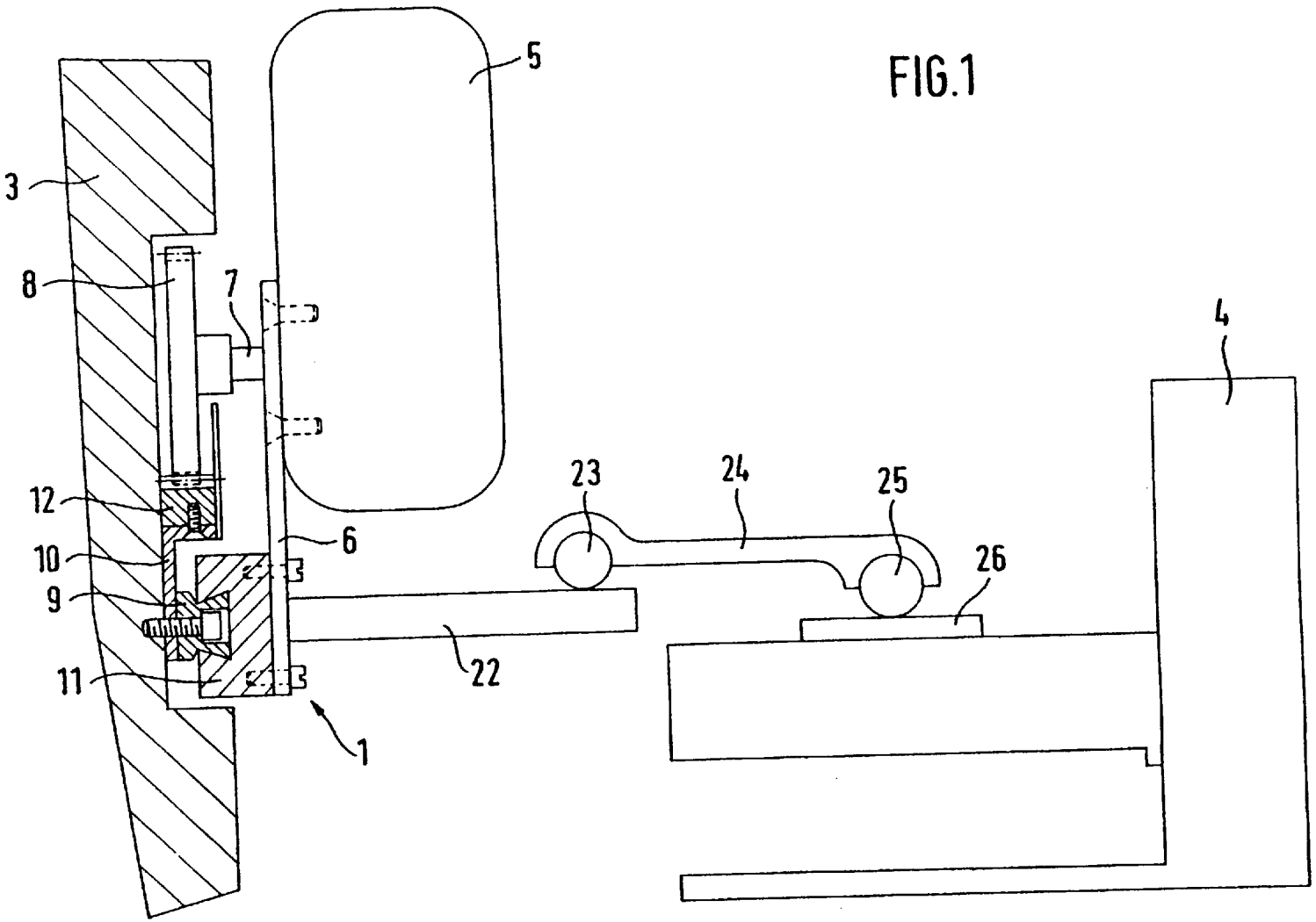
FIG. 1 a schematic view on to a first exemplified embodiment of the running unit transverse to the sliding door.

The device for opening and closing a sliding door, in particular of vehicles, depicted in FIGS. 1 to 9 consists of a running unit 1 (eg FIG. 1) and a locking unit 2 (eg FIGS. 3 and 4) wherein the running unit 1 ensures movement of the sliding door 3 substantially in the longitudinal direction with respect to the vehicle and the locking unit 2 ensures a movement for closing or locking the sliding door 3 perpendicular to the longitudinal direction of the vehicle. In the open state the sliding door 3 is arranged offset parallel to the body and runs in at least one guide which is not shown provided on the body, this guide being curved slightly inwards at one of its ends so that in the region of the aperture the sliding door 3 is moved on to the aperture in a combined movement in the longitudinal direction with respect to the wall and perpendicular to the wall, by which means the closing or locking path which is controlled by the locking unit 2 is small, ie the door is forcibly directed by the guide so close to the body that only a very small space has to be bridged by the locking unit 2.

As its essential driving part the running unit has a running motor 5 which is fastened to a base plate 6. The motor shaft 7 of the running motor 5 passes with free rotation through the base plate and carries a drive pinion 8. A linear guide rail 9 extending over the entire width of the sliding door 3 is rigidly connected to the sliding door 3 via a holding bracket 10. The linear guide rail 9 runs in a running carriage 11, or vice versa, which is bolted to the base plate 6. Attached to the holding bracket 10, likewise over the entire width of the sliding door 3, is a toothed rack 12 which is in engagement with the pinion 8 driven by the electric motor 5.

In the immediate vicinity of the edges the linear guide rail 9 possesses grooves, which are not illustrated, extending in the longitudinal direction on both sides of each edge and which in cross-section have the shape of a segment of a sphere. The running carriage 11 grips over the guide rail 9 in the shape of a U or in dovetailed manner. In the positions assigned to the guide grooves the running carriage 11 possesses depressions for accommodating a row of balls in such a way that four rows of balls are present which run in the allocated guide grooves of the guide rail 9. Fixedly attached to the base plate 6 approximately centrally with respect to the rectangular running carriage 11 is a lever 22 which is connected via a ball-and-socket joint 23 to a bar 24 which is coupled via a second ball-and-socket joint 25 to a bearing 26 rigidly connected to the chassis 4 of the vehicle. The bearing 26 can be provided in the region of the steps of the opening of the vehicle or at another suitable point, eg beneath the vehicle floor.

Figure 2:
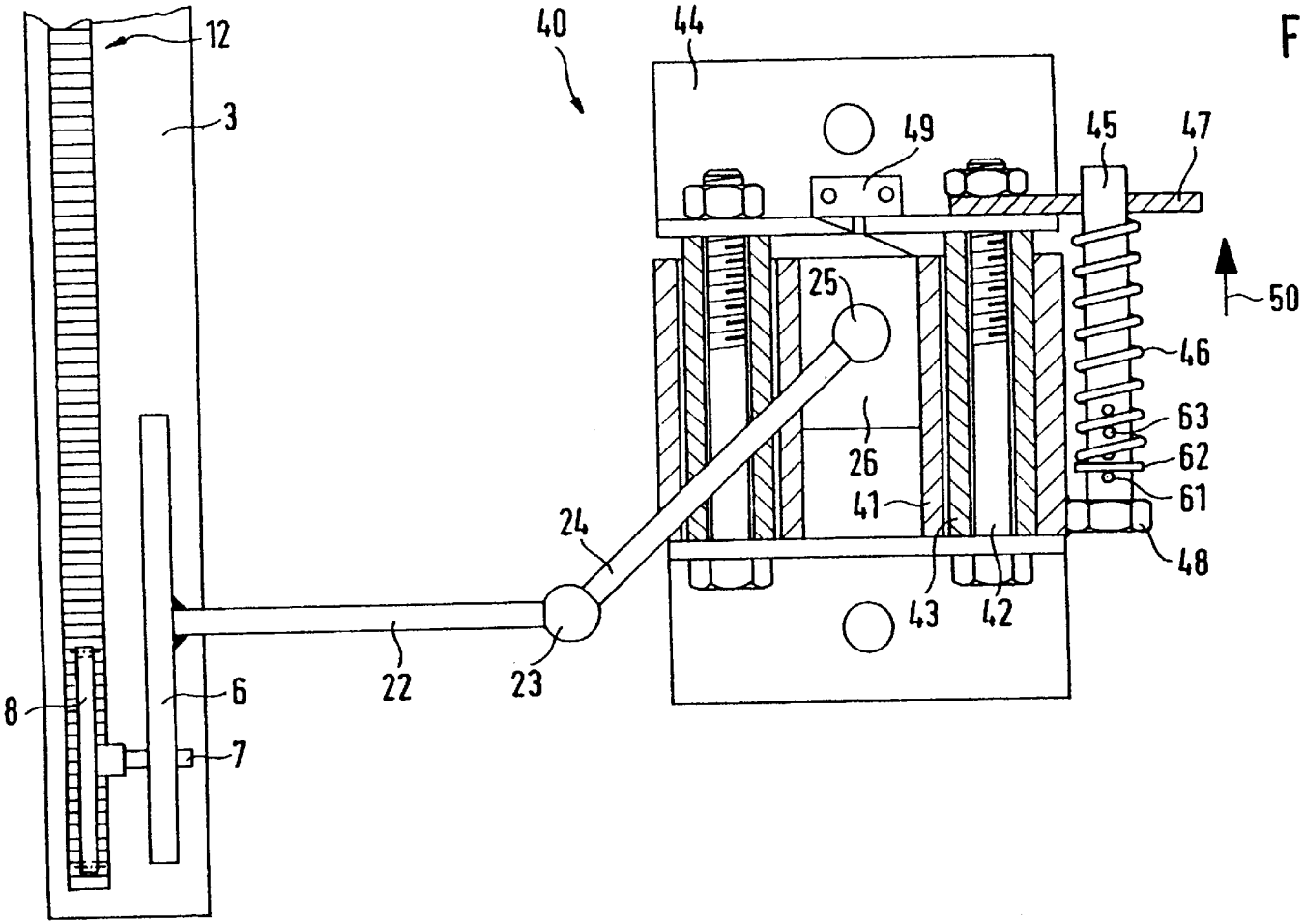
FIG. 2 a schematic view on to the lever arrangement of the exemplified embodiment according to FIG. 1, the crushing safeguard device being additionally provided.

In FIG. 2 parts of the device according to FIG. 1 are illustrated, a crushing safeguard device 40 being additionally provided here. The bearing 26 is fastened in this case to a displacement part 41 which in the exemplified embodiment has two bores for receiving slide bushes 43 arranged in each case on an axle 42. The axles 42 are fastened by a mounting part 44 connected to the chassis 4. The mounting part 44 has brackets between which the slide bushes 43 and the displacement part 41 are arranged and permits a longitudinal displacement movement of the displacement part 41 within preset bounds. Provided between the mounting part 44 and the displacement part 41 is a compression spring 46 arranged on a shaft 45, the compression spring 46 being braced against an arm bracket 47 connected to the mounting part 44 and a nut 48 connected to the sliding part 41. The pretensioning force exercised by the compression spring 46 on the displacement part 41 is adjustable. This is implemented in this case, as a possible variant for example, in that several bores 63 are present in the shaft 45. With the aid of a disk 62 and a pin 61 which is pushed into one of the bores 63 the pretensioning path and hence the pretensioning force of the spring 46 can be set. Arranged with the mounting part 44 is a microswitch 49 the switch contact of which works together with the displacement part 41. The microswitch 49 is connected to the control device which is not illustrated and inter alia controls the running motor 5 of the running unit 1. The displacement part 41 sliding on the slide bushes 43, the compression spring 46 and the microswitch 49 together form a crushing safeguard device which is triggered when a force directed in the displacement direction of the door towards the open position is greater than the force of the compression spring 46, taking the transmission losses into consideration, as a result of which the displacement part 41 shifts in the direction given by the arrow 50 (displacement direction into the open position).

Of course a different design for the crushing safeguard device 40 can be provided. Thus for example only one axle 42 with slide bushes 43 can be provided. The essential thing is that the bearing 26 is mounted displaceably against a pretensioning force and in its longitudinal displacement triggers a switch. Equally, a crushing safeguard device according to FIG. 9 which provides for a fixed bearing 26 and a variable-length pivot lever 24 (70 in the development) can be provided. In this case this involves a telescopic rod 70, the components of which 78, 80 can be pushed into one another against the force of a spring 72. Depending on the arrangement of the components 78, 80 the telescopic rod can be constructed as a tension or compression model. The pretensioning force of the spring 72 can be regulated with the aid of a threaded joint 74. At a preset force which has the consequence of a certain change in length of the telescopic rod 70 an initiator 76 is actuated which is connected to a control device which is not shown, which inter alia controls the running motor 5 of the running unit 1.

Figure 3:
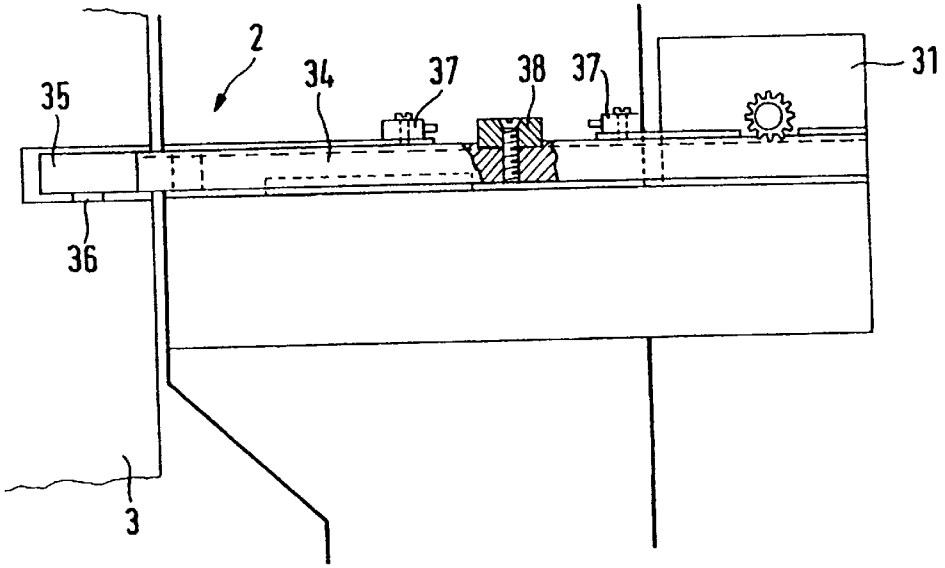
FIG. 3 a side elevation of an exemplified embodiment of the locking unit.
Figure 4:
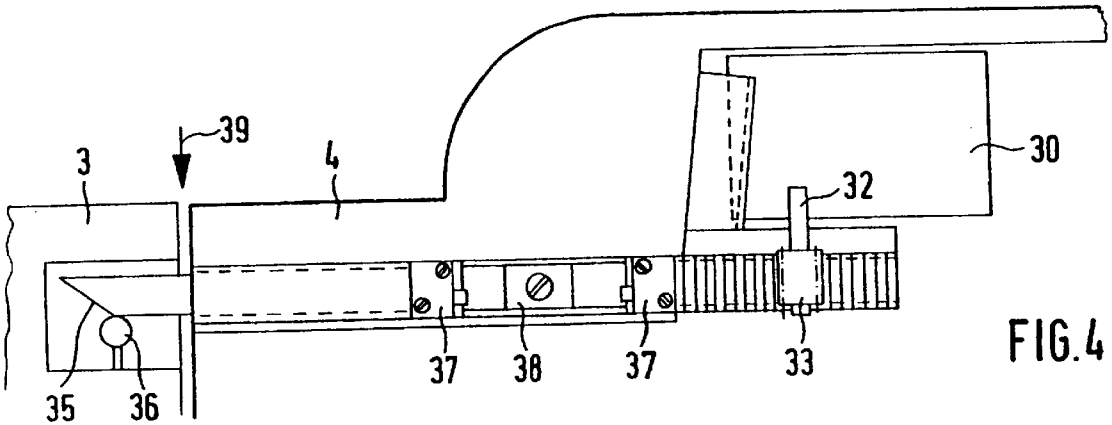
FIG. 4 a view of the locking unit according to FIG. 3.

In FIGS. 3 and 4 a locking unit 2 is illustrated which operates with the running unit 1 and also has an electric motor 30 connected to the control device which is not shown and also to the chassis 4 or the wall of the vehicle via a retaining plate 31. Seated on the shaft 32 of the motor 30 is a pinion 33 which is in engagement with a toothed rack 34. The toothed rack is led in a guide which is not illustrated in further detail and is rigidly connected to the chassis, having at its end a locking member 35 which comes into contact with a catch member, which normally represents the latch, fastened to the door. As can be seen in FIG. 4, the locking member 35 possesses a sloping surface and the catch member 36 is provided with a curved surface. On shifting the toothed rack or the locking member 35 forward, by the sloping surface of the locking member 35 sliding along on the curved surface of the catch member 36 the door 3 is pulled in the direction specified by the arrow 39. The catch member 36 and the locking member 35 can also be constructed in different manner, the essential point being that at the same time as transferring the locking member 35 into the locking position the door 3 is moved at right angles to the wall. The same applies for transference into the open position.

The catch member 36 and the locking member 35, ie the toothed rack, should be arranged in such a way that the manually lockable lock usually provided on the sliding door of a vehicle, or the position at which the lock is fitted, is used.

To control the locking unit 2 the guide of the toothed rack 34 is provided with end switches 37 which work together with a limit stop 38 fastened to the toothed rack 34 and which are connected to the control device.

The mode of operation of the device depicted in FIGS. 1 to 4 is as follows.

When the sliding door 3 is in the open position, in which it is arranged offset parallel to the wall of the vehicle and is to be moved into the closed position, the running motor 5 is activated via a switching signal from the control device. The control device can be connected for example to an input keyboard on the instrument panel of the vehicle, it being possible for commands for opening and closing the sliding door 3 to be entered by the driver via the keyboard. In the fully open position of the sliding door the lifting arrangement consisting of the lever 22, bar 24 and ball-and-socket joints 23 and 25 are in the position illustrated in FIG. 2.

After switching on the running motor 5 the drive pinion 8 rotates and moves along on the toothed rack 12 as a result of which the door 3 is displaced in the longitudinal direction counter to the arrow 50, while at the same time the linear guide rail 9 slides in the running carriage 11. When the sliding door 3 moves along in the sliding door guide fitted on the body 4 it is forcibly guided on to the body at the end of the longitudinal movement by the curved guide or at the aperture in the body in such a way that there is only a quite small space between the door 3 and the body when the door is located in front of the door opening.

During guidance of the door to the opening, the bar 24 pivots via the joints 23 and 25 in a horizontal plane, ie in the plane of the paper of FIG. 2, about the bearing 26. Provided in the region of the linear guide rail 9 are end position switches, which can be inductive, capacitative, mechanical, optical or the like, which are connected to the control device, one end position switch signaling to the control unit that the sliding door 3 is located in the position opposite the door opening. The control device then switches the running motor 5 off and the motor 30 of the locking unit 2 on which displaces the toothed rack 34 via the pinion 33. In doing so the sliding door 3 is drawn fully into the door opening through the interaction of the locking member 35 and the catch member 36 and the bar 24 pivots into its final position which assumes approximately the same angle with respect to the longitudinal direction of the vehicle towards the other side as does the bar 24 in the open position. The key factor is that in the closed position of the door the bar 24 is pivoted beyond the dead center of the pivot movement since then the start movement is easier. In this case the dead center is defined as the position in which the bar 24 lies in the longitudinal direction of the vehicle, ie at 90° with respect to the lever 22.

If during closure of the sliding door 3 an obstacle, for example a person or the arm or hand of a person, blocks the movement of the door, a force is exercised on the bearing 26 via the linear guide rail 9, the running carriage 11, the lever 22, the joint 23, the bar 24 and the joint 25 as a result of which it shifts in the longitudinal direction against the force of the compression spring 46. In doing so the displacement part 41 acts on the switching member of the microswitch 49 which delivers a switching signal to the control device. The control device immediately switches off the running motor 5 of the running unit 1 or switches the motor to the opposite direction of rotation, as a result of which the door shifts once more in the direction given by the arrow 50. In such an embodiment the crushing safeguard device can also be called a "reversing device". In this way crushing of people or objects during the automatic closure of the door 3 is prevented.

Figure 9:
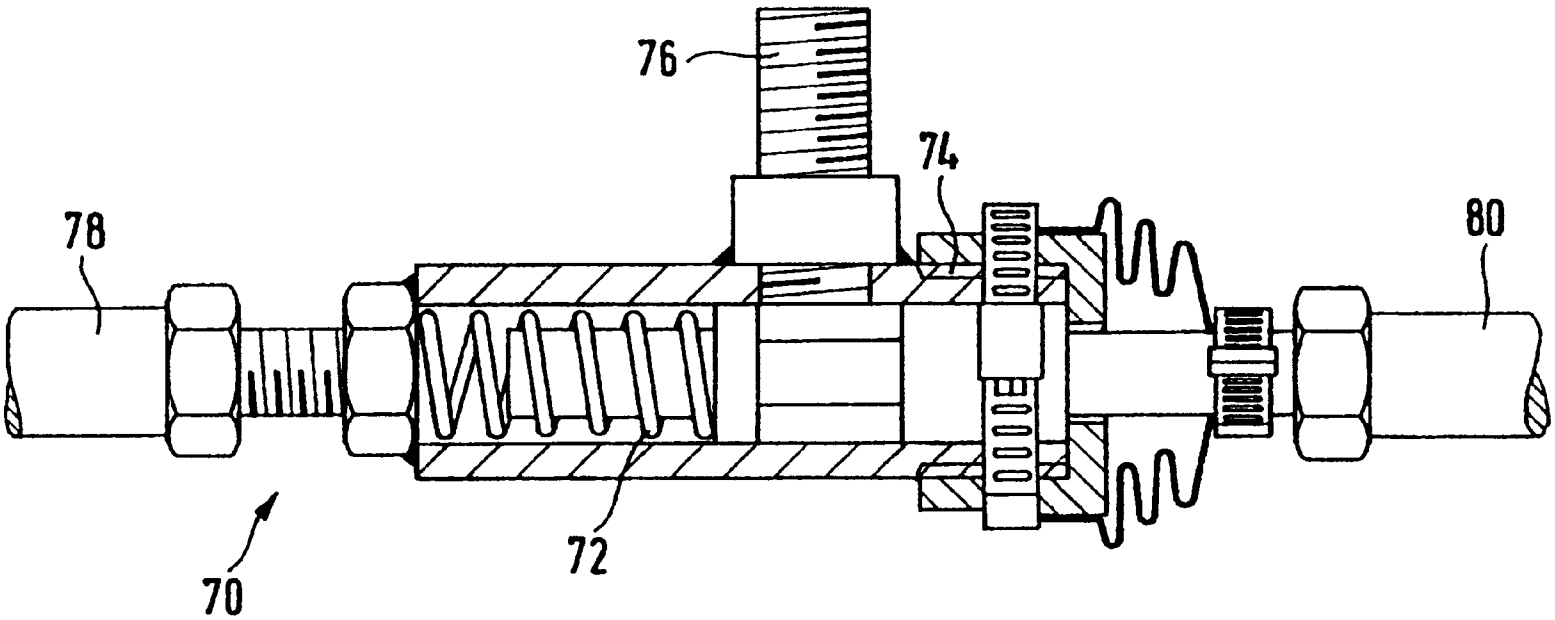

The crushing safeguard device according to FIG. 9 functions in analogous manner.

The spring 46 or 72 allows adjustment of the switching force at which what is called the crushing safeguard should be triggered. This must be of such a magnitude that no injuries occur. The acceleration force occurring on starting to move the door 3 from the open to the closed position is usually greater than the set switching force so that the control device would immediately switch the motor 5 off again. This must be prevented and a sensor, for example a proximity switch, is provided which on starting to move the door is effective for example over 2 cm and which delivers a signal to the control device through which the safeguard device is rendered inactive, ie is put out of operation. In similar manner, at the end of the displacement path of the door the friction force is likewise greater than the switching force, as a result of which the safeguard device 40 is triggered once more. Thus at the end of the displacement path a sensor is also provided which activates the crushing safeguard device over a very small displacement path.

In the exemplified embodiment presented according to FIGS. 2 and 9 a mechanical crushing safeguard device is provided. Of course an electronic crushing safeguard is also possible in which the force acting on the door is detected via force sensors and a control program determines with a microcomputer whether anomalous force conditions are occurring. In such an exemplified embodiment only the bearing 26 in accordance with FIG. 1 is provided.

Opening of the sliding door happens in the same manner in reverse sequence.

Figure 5B:
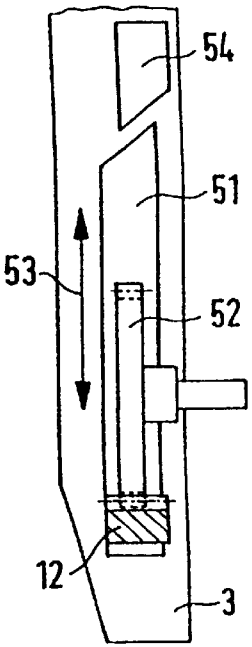
FIG. 5*b* a view of the arrangement according to FIG. 5*a* transverse to the sliding door.
Figure 5A:
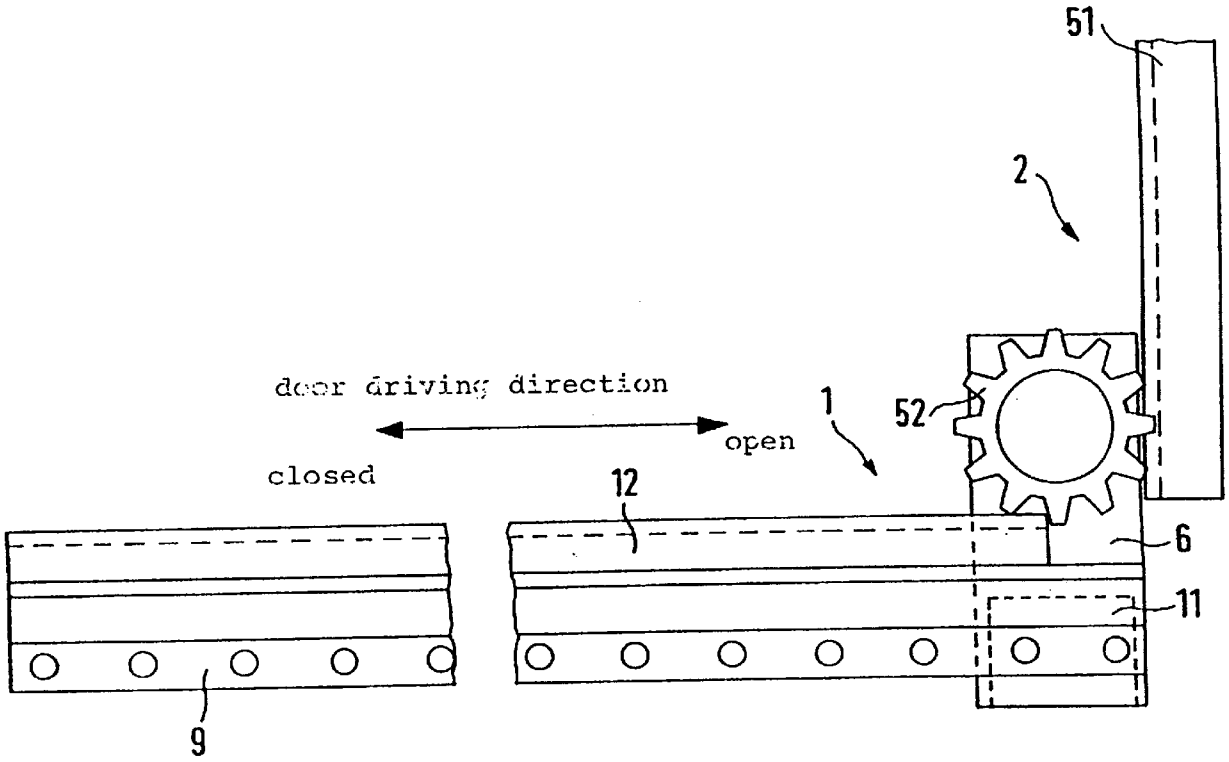
FIG. 5*a* a schematic view of parts of the running unit and the locking unit according to a further exemplified embodiment of the invention.

FIGS. 5*a* and 5*b* show a further exemplified embodiment of the running unit 1 and of the locking unit 2, wherein here, however, only the most important parts are visible. The key idea in this exemplified embodiment is that only one motor and one drive pinion are used for the running unit 1 and for the locking unit 2. The running unit is of similar construction as that in FIG. 1 and possesses the toothed rack 12 for the running movement, the guide rail 9 for the running carriage 11 and correspondingly the base plate 6 for accommodating the running carriage 11, the electric motor which is not shown and the pinion 52. As in the above exemplified embodiment, these parts are arranged in the door. In accordance with FIG. 5*a* the locking unit 2 possesses a locking toothed rack 51 which is likewise fastened to the door and which is arranged perpendicular to the toothed rack 12 for the running unit. The coordination of the guide rail 9 of the running unit, the toothed rack 51 of the locking unit and of the pinion 52 is such that on closing the door to the end movement of the running unit 1 the pinion 52 is in engagement with the toothed rack 12 of the running unit and comes out of engagement at the end of the closing movement and engages in the teeth of the locking rack 51.

According to FIG. 5*b* the toothed rack 51 is moved by the drive pinion 52 in the direction indicated by the arrow 53, the locking direction being shown by the arrow as upwards. The reference number 54 schematically indicates the catch member or the lock latch which in this case is rigidly connected to the chassis, for example the C-pillar of a vehicle.

Figure 6:
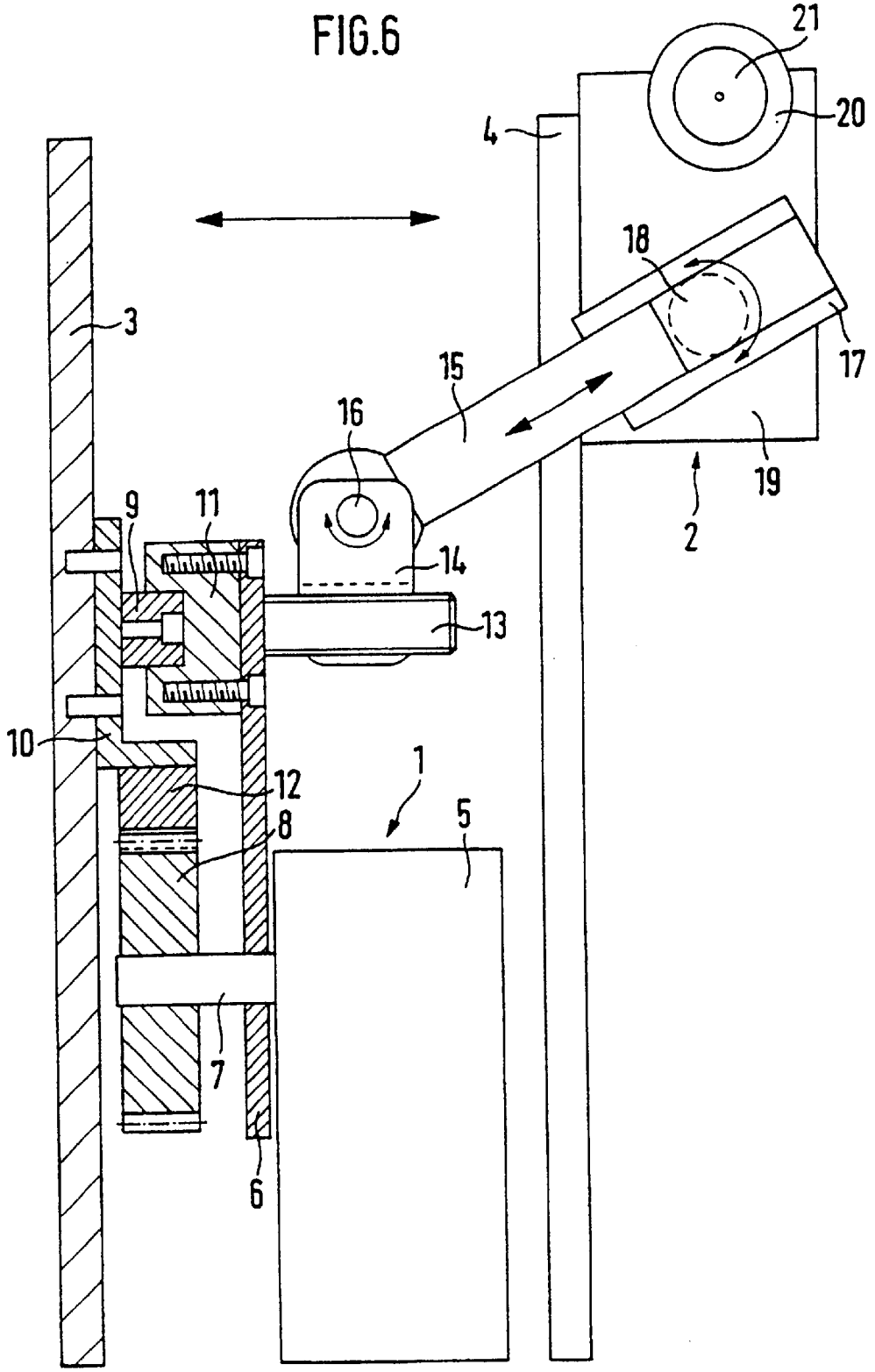
FIG. 6 a schematic view of the running unit and of the locking unit according to a further exemplified embodiment of the invention transverse to the sliding door.
Figure 7:
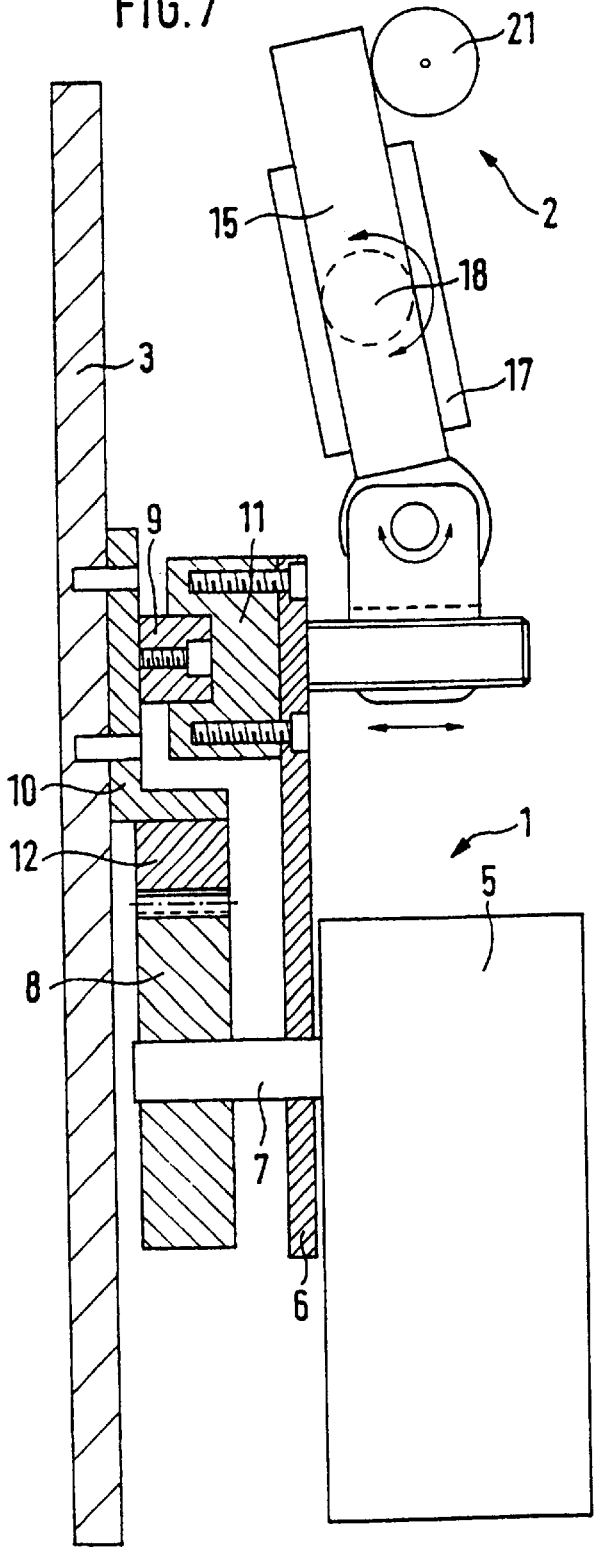
FIG. 7 a view corresponding to FIG. 6, but in the locked state.
Figure 8:
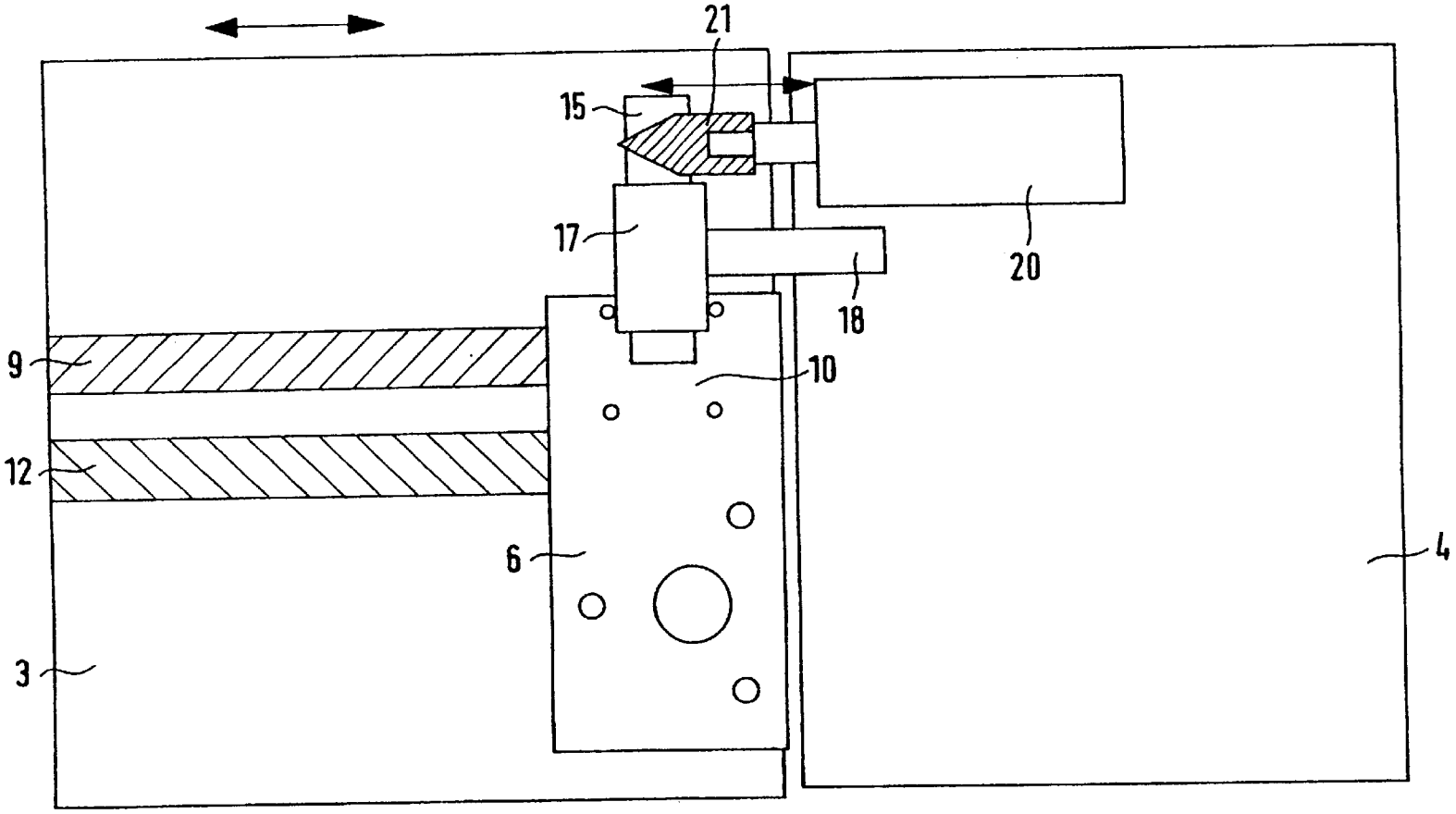
FIG. 8 a schematic view of the locking unit according to FIG. 6 and FIG. 7 parallel to the wall; and FIG, 9 development of the pivot lever 24.

FIGS. 6 to 8 show a further exemplified embodiment of the present invention, the same reference numbers designating the same parts as in FIGS. 1 to 5 so that their description is omitted.

The running unit 1 is constructed in similar manner to the running unit in FIG. 1 while the specific embodiment differs in the support device of the running unit.

On the base plate 6, approximately centrally with respect to the running carriage 11, a bolt 13 is fitted in fixed manner on which a fork head 14 is fastened. The fork head 14 serves as a mounting for a thrust lever 15 which is mounted by one of its ends pivotably at least in one plane perpendicular to the longitudinal direction of the vehicle via a swivel pin 16. The bearing is preferably constructed as a heavy-duty rocker bearing which permits certain degrees of freedom in different directions.

The thrust lever 15 is accommodated displaceably by its free end in a guide bush 17 which is mounted rotatably, via a pivot bolt 18 attached at right angles on its outer circumference, in a mounting 19 rigidly connected to the chassis 4. According to FIG. 8 the locking unit 2 has an electric motor 20 which in the exemplified embodiment is constructed as a spindle motor and which on the mounting is rigidly fastened to the chassis. The axle of the spindle motor 20 is connected to a closing cone 21. In the open state of the sliding door the closing cone is located in the retracted state so that the thrust lever 15 can pivot moves out and in accordance with FIG. 7 pushes the end of the thrust lever 15 towards the opening and thus fixes the thrust lever 15.

When the sliding door 3 is located in the open position shown in FIG. 6 and is to be moved into the closed position, the running motor 5 is activated as in the first exemplified embodiment and moves into the closed position and at the end of the longitudinal movement it is forcibly guided on to the body by the curved guide. In doing so the thrust lever 15 is displaced in the guide bush 17 in the axial direction, the guide bush 17 rotating counterclockwise and simultaneously pivoting the end of the thrust lever about the swivel pin 16. After the running motor 5 has been switched off the spindle motor 20 is switched on. The tip of the cone of the closing cone 21 is arranged with reference to the thrust lever 15 located in almost perpendicular position in such a way that the central axis of the thrust lever 15, as seen in FIG. 7, is shifted slightly to the left. The spindle motor 20 now pushes the closing cone 21 out as a result of which the latter sliding along the circumference of the thrust lever by its tip pushes the latter by its upper end to the left in the drawing according to FIG. 7. As a result of this, at the other end the bolt 13 is drawn towards the interior and the other end the bolt 13 is drawn towards the interior and the sliding door 3 tightly seals the door opening of the vehicle. In doing so the closing cone 21 and thrust lever 15 for the locking mechanism. The slope of the cone 21 is decisive for the closure path perpendicular to the body which is traversed by means of the locking unit 2. Opening of the sliding door happens in the same manner in reverse sequence.

Instead of the spindle motor 20 and the closing cone 21 the toothed rack with drive pinion provided according to FIGS. 3 and 4 can also be used.

In this exemplified embodiment according to FIGS. 6 to 8 a crushing safeguard device can also be provided in a manner similar to FIG. 2, the swivel pin 18 being extended with a smaller diameter. The end of the swivel pin is mounted in a displaceable arm bracket, the compression spring being arranged on the swivel pin 18 between the step and the arm bracket.

What is claimed is:

1. A device in combination with an opening and closing sliding door (3), in particular for vehicles, which closes an opening in a wall and is arranged displaceably substantially parallel to the wall in at least one longitudinal guide provided on the wall, having a running unit (1) which carries out the displacement movement and which possesses a linear drive (8, 12) provided with an electric motor (5) and a guide device (9, 11), wherein the linearly constructed driven member of the linear drive (12) and a member of the guide device (9) are fastened on the one hand to the door (3) and the driving member of the linear drive (5, 7, 8) as well as the other member of the guide device (11) on the other hand are fastened to a mounting (6) which is supported via a support arrangement (22, 23, 24, 25, 26) connected to the wall, having a locking unit (2) driven by an electric motor (20) which locks and unlocks the sliding door (3) in its position closing the opening while performing a movement perpendicular to the wall and having a control which encompasses position switches and controls the running (1) and locking unit (2), wherein the support arrangement (22, 23, 24, 25, 26) possesses at least one pivot lever (24) connected on the one hand to the mounting (6) and on the other hand to a bearing (23, 25) connected to the wall, each mounted in articulated manner, which converts a movement of the mounting (6) substantially perpendicular to the wall into a pivot movement.

2. A device in combination with an opening and closing sliding door according to claim 1, wherein the locking unit (2) possesses a linearly displaceable locking member (35, 21) and a catch member (36, 15) coming into engagement with the locking member, wherein said members (35, 36, 15, 21) are constructed so that engagement or disengagement of said members initiates a movement of the door perpendicular to the wall.

3. A device in combination with an opening and closing sliding door according to claim 2, wherein the surface of the locking member (35, 21) or of the catch member (35, 15) is of sloping construction.

4. A device in combination with an opening and closing sliding door according to claim 1, wherein the linear drive with electric motor and the guide device as well as the mounting of the running unit are arranged to form a unit capable of preassembly on a preferably trough-shaped part which is connected to the door.

5. A device in combination with an opening and closing sliding door according to claim 1, wherein the linear drive possesses a toothed rack (12) connected to the door (3) and a pinion (8) driven by the electric motor (5) fastened to the mounting (6) and the guide device possesses a linear guide rail (9) and a running carriage gripping around the linear guide rail at least in part.

6. A device in combination with an opening and closing sliding door according to claim 1, wherein the pivot lever of the support device is constructed as a connecting rod (15) arranged displaceably in a guide bush (17), wherein the guide bush (17) is mounted rotatably or pivotably on the bearing (19).

7. A device in combination with an opening and closing sliding door according to claim 1, the pivot lever is constructed as a rod (24) which is fastened on the one hand, preferably via a ball-and-socket joint (25), to the bearing (26) and on the other hand, preferably via a ball-and-socket joint (23) to a further lever (22) rigidly connected to the mounting (6).

8. A device in combination with an opening and closing sliding door according to claim 1, wherein the locking member is constructed at least in part as a toothed rack (34, 51) which can be driven by a pinion (33, 52) connected to the electric motor.

9. A device in combination with an opening and closing sliding door according to claim 6, wherein the connecting rod (15) simultaneously forms the catch member of the locking unit (2), wherein the locking member possesses a sloping surface which slides along on the circumference of the connecting rod (15).

10. A device in combination with an opening and closing sliding door according to claim 8, wherein the toothed rack (51) of the locking unit (2) is arranged on the door adjacent to the toothed rack (12) of the running unit in such a way that only one electric motor with pinion (52) is provided for the running unit (1) and for the locking unit (2) and the pinion (52) successively engages first with one toothed rack and then with the other toothed rack.

11. A device in combination with an opening and closing sliding door according to claim 1, wherein a crushing safeguard device (40) is connected to the control device which on application of a predetermined force on the door (3) in opposition to the displacement movement switches off the electric motor of the running unit (1).

12. A device in combination with an opening and closing sliding door according to claim 11, wherein the bearing (26, 19) of the pivot lever (24, 15, 14) is mounted displaceably against a defined, variably adjustable pretensioning force and that a switching device connected to the control device is provided which, depending on the displacement path, issues a signal for triggering the electric motor.

13. A device in combination with an opening and closing sliding door according to claim 12, wherein the pretensioning force is supplied by a spring (46) arranged in the displacement path of the bearing.

14. A device in combination with an opening and closing sliding door according to claim 12, wherein at the beginning and at the end of the displacement movement of the sliding door (3) from the open position into the closed position the switching device (25, 26) is put out of operation.

15. A device in combination with an opening and closing sliding door according to claim 11, wherein the pivot lever (24) is designed in such a way (70) that it is extended or shortened under a defined, variably adjustable pretensioning force and that a switching device connected to the control device is provided which, depending on the change in length, issues a signal for triggering the electric motor.

16. A device in combination with an opening and closing sliding door according to claim 15, wherein the pretensioning force is supplied by a spring (72) integrated in the pivot lever.

17. A device in combination with an opening and closing sliding door according to claim 11, wherein a crushing safeguard device (40) is connected to the control device which on application of a predetermined force on the door (3) in opposition to the displacement movement switches the direction of rotation of the electric motor.

* * * * *